US005385308A

United States Patent [19]

Gearing et al.

[11] Patent Number: 5,385,308

[45] Date of Patent: Jan. 31, 1995

[54] CHIPPER-SHREDDER

[75] Inventors: Thomas W. Gearing, Wauwatosa; Andrew A. Haver, West Bend; Gerald M. Hoinacki, Germantown, all of Wis.

[73] Assignee: H. G. Products, Inc., Wauwatosa, Wis.

[21] Appl. No.: 97,174

[22] Filed: Jul. 23, 1993

[51] Int. Cl.[6] ..... B02C 19/18; B02C 18/24

[52] U.S. Cl. ..... 241/101.7; 241/92

[58] Field of Search ..... 241/92, 101.7, 296; 144/176

[56] References Cited

U.S. PATENT DOCUMENTS

| | | | |
|---|---|---|---|
| 522,945 | 7/1994 | Schutz . | |
| 750,329 | 1/1990 | Windingstad et al. . | |
| 810,204 | 1/1906 | Harrison et al. . | |
| 1,211,566 | 1/1917 | Fortney . | |
| 1,573,040 | 2/1926 | Crites . | |
| 1,975,406 | 10/1934 | Reschke . | |
| 2,247,665 | 7/1941 | Ottersland | 241/92 |
| 2,625,332 | 1/1953 | Rogers et al. . | |
| 3,229,923 | 1/1966 | Conley et al. . | |
| 3,240,247 | 3/1966 | Lautzenheiser et al. . | |
| 3,627,010 | 12/1971 | Rueff . | |
| 3,682,400 | 8/1972 | Smith . | |
| 3,700,177 | 10/1972 | Pearson . | |
| 3,712,353 | 1/1973 | Ferry . | |
| 3,817,462 | 6/1974 | Hamlin . | |
| 3,963,183 | 6/1976 | Paulsen . | |
| 4,544,104 | 10/1985 | Carlsson . | |
| 4,824,034 | 4/1989 | Baker . | |
| 4,834,302 | 5/1989 | Baker . | |
| 4,875,630 | 10/1989 | Carlson et al. . | |
| 4,951,882 | 8/1990 | Ober . | |
| 5,018,672 | 5/1991 | Peck et al. . | |
| 5,085,376 | 2/1992 | Litchenburg . | |
| 5,102,056 | 4/1992 | Ober . | |
| 5,156,345 | 10/1992 | Baker . | |

FOREIGN PATENT DOCUMENTS

| | | | |
|---|---|---|---|
| 2727164 | 6/1977 | Germany | 241/101.7 |

OTHER PUBLICATIONS

Trade literature regarding Troy-Bilt Chipper/VAC.

*Primary Examiner*—Douglas D. Watts
*Attorney, Agent, or Firm*—Jansson & Shupe, Ltd.

[57] ABSTRACT

Disclosed is a machine for comminuting lawn refuse and having a refuse-receiving hopper with a hopper opening. An aspect of the invention involves a vacuum adapter attached to the hopper and substantially spanning the opening. The adapter has a collar for removably receiving a vacuum hose in air flow communication with the hopper. Preferably, the hose is a ribbed irrigation hose which is widely available at low cost. The hose is retained by a diaphgragm-like resilient member so that the hose readily pivots 360° and is securely retained. Other aspects of the invention involve a closure for the branch feed tube, a novel engine mounting arrangement and a unique strut mount which substantially lessens the tendency of the machine to "walk" during operation.

13 Claims, 8 Drawing Sheets

FIG. 3
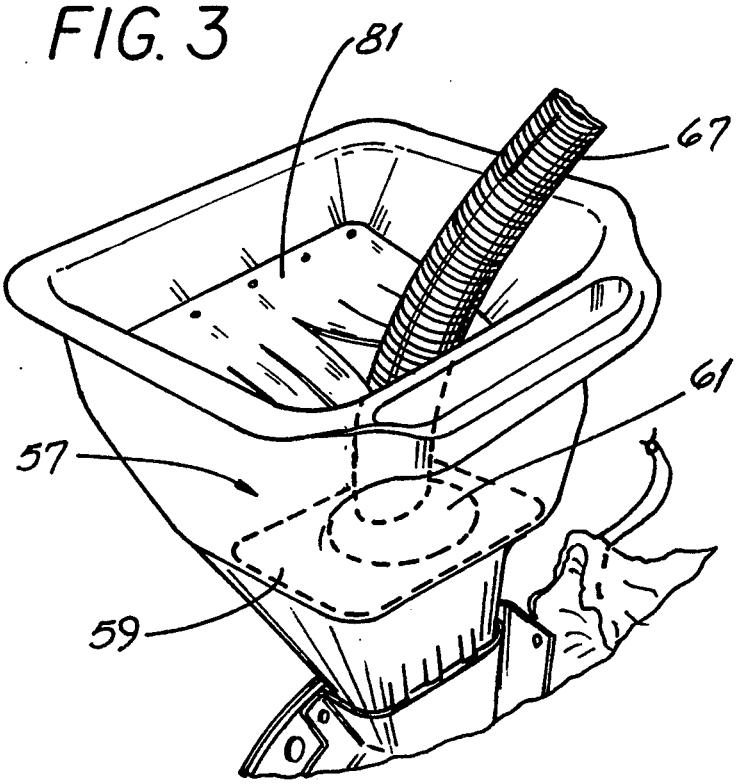
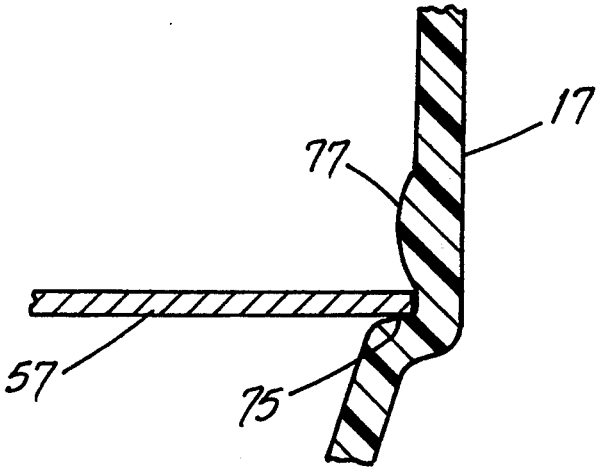
FIG. 5

FIG. 7
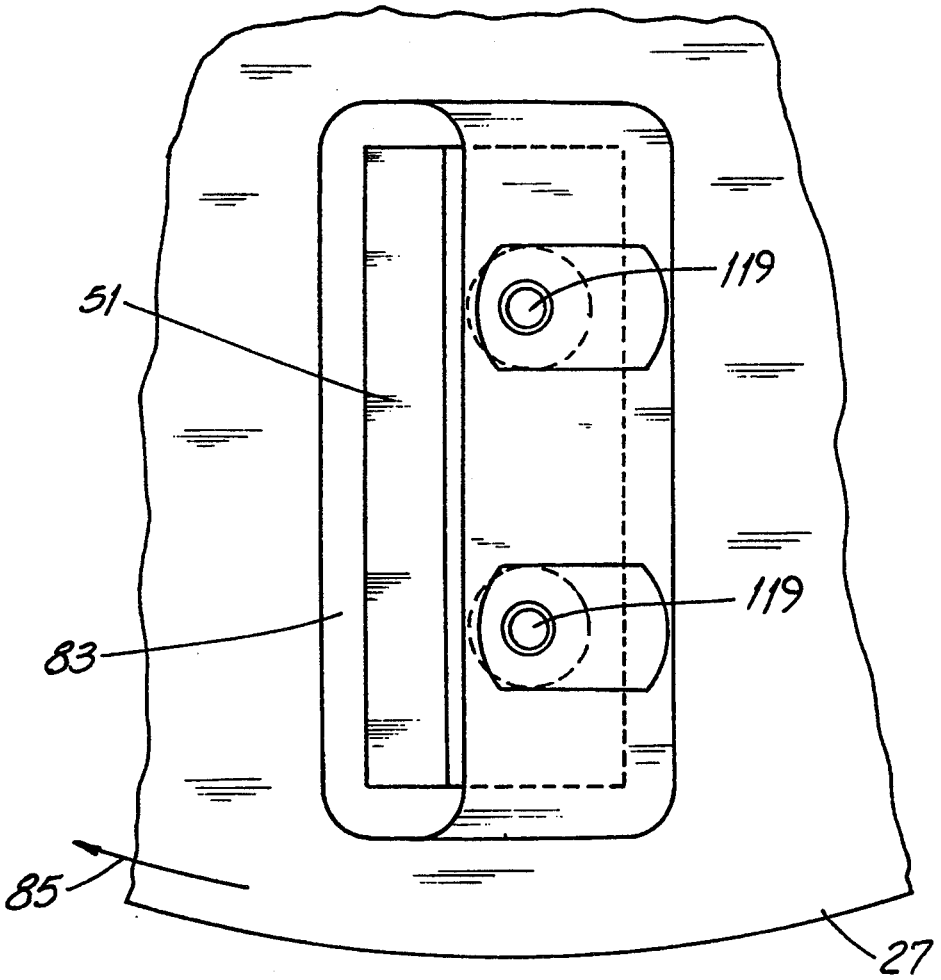
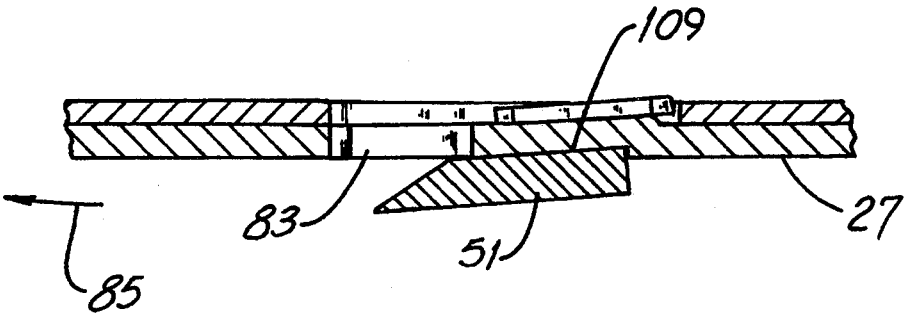
FIG. 8A

CHIPPER-SHREDDER

FIELD OF THE INVENTION

This invention relates generally to comminuting and, more generally, to comminution of lawn refuse such as grass clippings, leaves, tree branches and the like.

BACKGROUND OF THE INVENTION

Machines, often referred to as "chipper-shredders," have been in wide use for years for comminuting lawn and yard refuse. Owners of residential and commercial property use such machines to mulch grass clippings, small twigs and branches, leaves and the like. In the past, it had been common practice to place the comminuted refuse into bags and dispose of the bags and refuse in a landfill.

More recently, municipalities are becoming more concerned about the cost of procuring landfill space. A growing number of such municipalities prohibit many types of lawn refuse from being placed into a landfill. Consequently, chipper-shredder machines are increasing importance since they reduce lawn refuse to small particle and "piece" sizes entirely suitable for use as garden, lawn and tree mulch. Chipper-shredder machines play an important part in returning valuable natural organic material, pulverized lawn refuse, to the soil.

There are number of manufacturers of such chipper-shredder machines and the patent literature illustrates several different machine configurations. Examples of such machines are shown in U.S. Pat Nos. 5,156,345 (Baker); 5,102,056 (Ober); 4,824,034 (Baker); 4,544,104 (Carlsson); 3,817,462 (Hamlin) and others. While such machines have been generally satisfactory for their intended purpose, they are characterized by certain disadvantages.

Many chipper-shredder machines include the capability to attach a vacuum hose to the machine and clean up lawn refuse "fines" by vacuum. One disadvantage of certain known chipper-shredder machines involves the vacuum hose arrangement. The configurations shown in U.S. Pat. Nos. 5,018,672 (Peck); 4,875,630 (Carlson) and 3,712,353 (Ferry) are typical in that all use a side-mounted vacuum hose.

Such side-mounting arrangements are thought to have little pivoting capability. And in any event, it is very clear that a substantial length of hose is required just to position the vacuum mouth to the side of the machine opposite the mounting opening. Further, the hose used for such purpose is often specially selected for such applications and is relatively expensive. Some hoses require tools for attachment and removal.

Chipper-shredders are usually equipped with "free-swinging" comminuting "hammers" or blades attached to a grinding rotor. Often, the blades are Y-shaped and the two arms of the "Y" are bent slightly in opposite directions away from the plane of the blade body. Examples of blade configurations of this general type are shown in U.S. Pat. Nos. 1,211,566 (Fortney) and 1,975,406 (Reschke). A disadvantage of this blade type is that twigs and small branches tend to become wedged between the blades and carried around with the grinding rotor rather than being chopped.

Still another disadvantage of known chipper-shredders arises from the inclusion of a branch-receiving chute or tube. Small branches are thrust into the tube to be ground up by the rotor. Examples of such chutes are shown in the above-noted Ober and Baker '034 patents. Often, the tube is simply left open when not in use. If open, air flows down the tube while the vacuum hose is being used and reduces the vacuum hose "cleanup" capability of the machine. If the tube is closed when not in use, it is typical to employ a custom-fabricated closure for the purpose. One manufacturer uses a permanently-attached, spring-biased swinging plate.

Another disadvantage of known chipper-shredders is their tendency to "walk" or "dance" when in use. This annoying characteristic occurs when the machine rests on a hard surface, e.g., a concrete or asphalt driveway, and is especially typical of chipper-shredders powered by internal combustion engines and having a "cantilevered" drive shaft, i.e., a drive shaft with no outboard support bearing. Such engines inherently exhibit more vibration than electric motors and cantilevered drive shafts tend to whip slightly due to the almost inevitable imbalance in load.

Still another disadvantage of known chipper-shredders is that their prime mover, e.g., a gasoline engine or an electric drive motor, is mounted in such a way that the machine is very difficult to move from location to location. U.S. Pat. No. 5,085,376 (Litchenburg) shows a machine in which the gasoline engine is mounted well away from the wheel axle. Tipping or lifting the machine is thereby made unnecessarily difficult.

Yet another disadvantage of known chipper-shredders involves the manner of mounting the chipper knives which are preferably seated in some sort of pocket to help reduce the stress on the knife-securing bolts. In certain known products, the pocket is formed in the chipper plate by a milling operation which involves removing metal from the plate. Another known way to form a pocket is to grind it. And yet another known chipper-shredder does not use a pocket at all but, rather, welds a back-up bar onto the chipper plate to support the knife. These operations add significantly to the cost of manufacture.

An improved chipper-shredder which incorporates features addressing the above and other disadvantages would be an important advance in the art.

OBJECTS OF THE INVENTION

It is an object of the invention to provide an improved chipper-shredder overcoming some of the problems and disadvantages of the prior art.

Another object of the invention is to provide an improved chipper shredder having a novel top-mounted readily-pivotable vacuum hose arrangement.

Another object of the invention is to provide an improved chipper shredder wherein the vacuum hose is readily attached and detached without the use of tools.

Still another object of the invention is to provide an improved chipper shredder wherein the vacuum hose is inexpensive, readily-available drainage or irrigation tubing.

Another object of the invention is to provide an improved chipper shredder wherein the branch-receiving tube is readily closed or opened using an inexpensive, readily-available carton closure.

Yet another object of the invention is to provide an improved chipper shredder having an improved swinging blade configuration.

Another object of the invention is to provide an improved chipper shredder which substantially reduces vibration.

Another object of the invention is to provide an improved chipper shredder which is easy to move from location to location. How these and other objects are accomplished will become more apparent from the following descriptions and from the drawing.

SUMMARY OF THE INVENTION

As will become more apparent from the following descriptions, the new chipper-shredder machine includes among its novel features the imaginative use of components which are commonly available and made in large quantities but which are used for widely disparate purposes. Unique utilization of such mass-produced, low cost components is a significant factor in reducing the cost of the machine.

The invention involves a machine for comminuting lawn refuse which is deposited into a refuse-receiving hopper with a hopper opening. In the improvement, a unique vacuum adapter is attached to the hopper and substantially spans the opening. The adapter has a collar for removably receiving a vacuum hose in air flow communication with the hopper and the distal end of such hose is used like a vacuum wand. The air-entrained lawn refuse flows through the hose and into the hopper.

More particularly, the hopper has a shoulder extending at least partially around the interior perimeter of the hopper and the adapter is retained on the hopper in shoulder-abutting relationship. Adapter retention is preferably by at least one projecting member adjacent to but spaced slightly from the shoulder for securing the adapter to the hopper. The adapter is thereby readily "snapped" into and out of the hopper without the use of tools.

In another aspect of the invention, the hose is generally circular in cross-section and the collar includes a diaphragm-like resilient member having a generally circular aperture through it. The diameter of the aperture is somewhat less than that of the hose so that the hose is not only pivotably retained by the resilient member but it may be attached and released without the use of tools. Most preferably, the hose is a commonly-available irrigation hose made of a homogeneous, non-reinforced plastic material and having a plurality of spaced circumferential ribs.

In another aspect of the invention, the machine has a grinding rotor with at least one comminuting blade (and preferably four such blades) pivot-mounted on for "swinging" 360° rotation with respect to the rotor. The blade has a blade body coincident with a plane and also has a pair of comminuting fingers extending from the body. One finger is substantially coincident with the plane and the other finger is bent away from the plane. And the fingers are laterally spaced apart (in the plane of the blade body) by a slot. An advantage of this type of blade is described below.

The grinding rotor comprises a part of a comminuting and fan assembly which also has a chipper plate with at least one chipping aperture through it. A chipping knife is mounted on the plate adjacent to the aperture and, significantly, the chipping knife is received in an upset-formed pocket, i.e., in a pocket formed in a stamping operation involving no metal removal.

The assembly also has a fan plate and the chipper plate and the fan plate are secured together by rivets. Most preferably, the pocket is upset-formed simultaneously with rivet setting.

The machine also has a vacuum-producing, refuse-ejecting fan and a housing enclosing the rotor and fan. A tube (sometimes referred to as a chipper chute) is coupled to the housing for directing tree branches toward the chipping plate and the tube includes a branch-receiving mouth. A fully removable closure is provided for sealing the mouth when lawn refuse is flowing through the hose. When the tube is so sealed, the vacuum at the adapter-attached hose is increased and the hose does a better job of picking up lawn refuse. In a highly preferred machine, the closure is sized and shaped to fit a commercially-available frozen food container and is available from a vendor of such containers. One exemplary closure is from a plastic, tub-like ice cream container.

The new machine also has a substantially-reduced tendency to dance or walk on a hard surface during use. A feature believed to be responsible for this characteristic involves a strut mounting bracket attached to the housing. The bracket includes a pair of spaced support members and a strut is retained between the support members and in spaced, "out-of-contact" relation to them.

More specifically, the support members are spaced by a first dimension and the strut has a width no more than about 95% of the first dimension. In known machines, the bracket spacing is about equal to the width of the strut and it is believed that this arrangement accounts for the fact that vibratory motion is readily transferred to the strut.

And that is not all—the new machine is very easy to move about. It has a machine-supporting axle and an internal combustion engine having a center of gravity. The engine is mounted with its center of gravity substantially vertically above the axle and in close proximity to such axle so that the machine is stable in use and readily tipped for machine relocation. Machine tipping and wheeling along its two wheels is made easy by the inclusion of a handle molded as part of the upper rim of the housing.

Further details of the invention are set forth in the following detailed description and in the drawing.

BRIEF DESCRIPTION OF THE DRAWING

FIG. 3 is a more detailed view of aspects of the hopper of the machine of FIG. 1.

FIG. 5 is a section view of a portion of the machine hopper and of a vacuum hose adapter mounted therein.

FIG. 7 is an enlarged elevation view of a portion of the chipper plate, an opening therethrough and a chipping knife mounted thereon. Parts are broken away.

FIG. 8A is a cross-section edge view of the plate and knife of FIG. 7 and also showing the fan plate and a weld nut used to secure the knife to the plate. Parts are broken away.

Detailed Description of Preferred Embodiments

Figure 1:
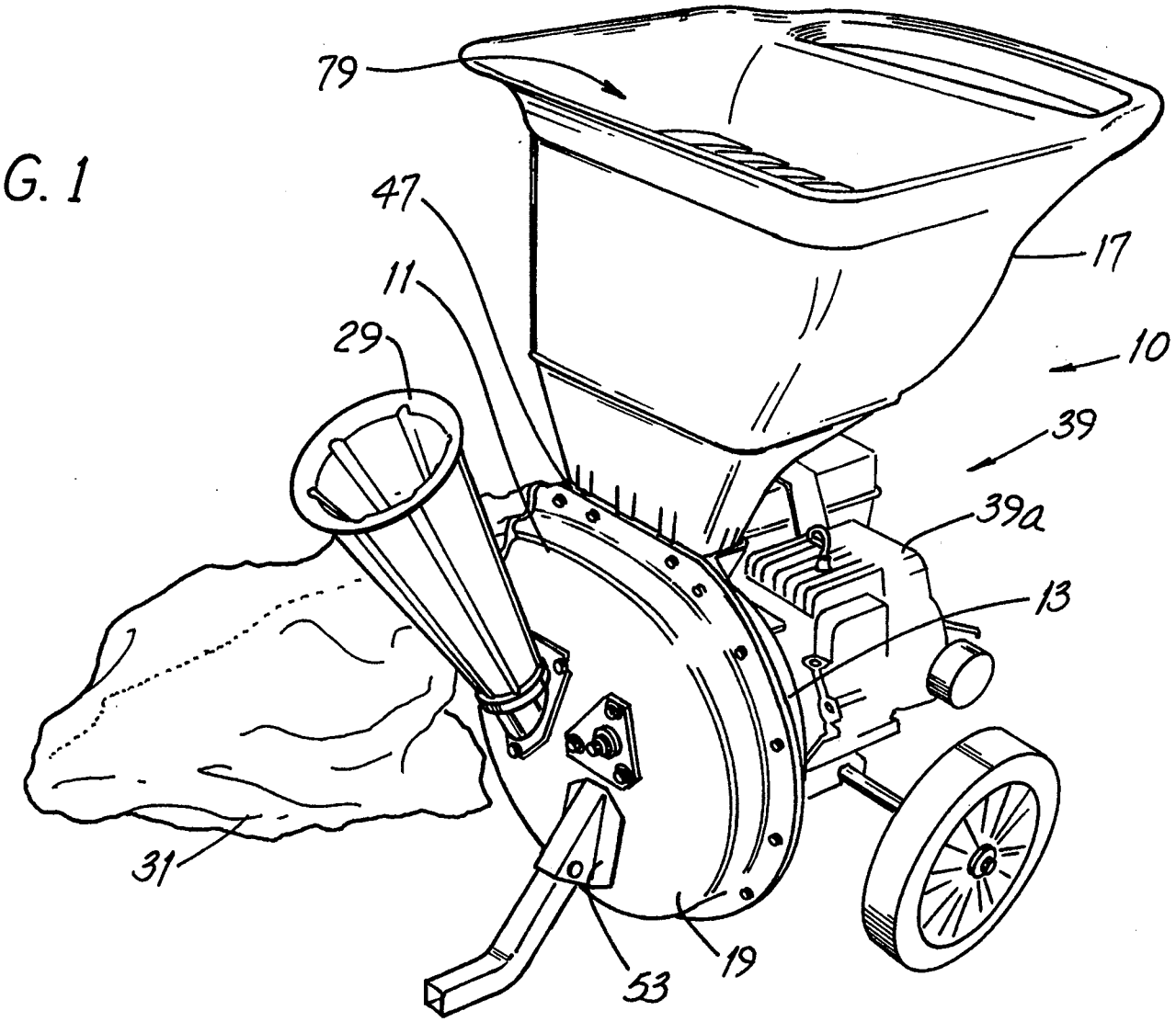
FIG. 1 is a perspective view of the new chipper-shredder machine.

Before getting into details of the new chipper-shredder machine 10, a general description is provided. Referring to FIGS. 1, 2, 6 and 10, the machine 10 includes a housing 11 having a grinding chamber portion 13 with a smooth, curved interior wall 14. Such portion 13 confines parts of a fan and comminuting assembly 15 for "processing," i.e. comminuting, lawn refuse fed into the housing 11 through the hopper 17. The housing 11 also has a fan chamber portion 19 in which is confined other parts of the assembly 15 including a fan 21 functioning as a centrifugal blower. Such blower creates a vacuum (in the grinding chamber portion 13 which, in effect, is the fan inlet), draws refuse into the housing 11 and provides (at the fan discharge port 23) a pressurized air stream which ejects such processed refuse. The plate 25 embodying the fan 21 is "back-to-back" with a chipper plate 27 which "chips" larger branches fed into the housing 11 through a tube 29 described below. A bag 31 is attached to the fan discharge port 23 to catch such refuse for later disposal.

A generally L-shaped mounting bracket 33 is attached to that side of the housing 11 defining the grinding chamber portion 13 and has a pair of openings receiving a cross axle 35 to which are mounted a pair of wheels 37. A "prime mover" 39 (either an internal combustion engine 39*a*—illustrated—or an electric motor) is mounted to the bracket platform 41 and has its center of gravity 43 approximately vertically above the axle 35. This arrangement makes it very easy to tip the machine 10 rearward toward the prime mover 39 by grasping the handle 45 formed on the edge of the hopper 17. The machine 10 can then be wheeled from place to place. And the prime mover 39 is mounted very low on the machine 10 for better resistance against accidental tip-over.

Referring also to FIGS. 7 and 8A, a receptacle-like hopper 17 is attached to an inlet port 47 on that side of the housing 11 defining the grinding chamber portion 13 for receiving refuse and directing it downward toward the grinding blades 49. Attached to the fan chamber portion 19 of the housing 11 is a cone-shaped tube 29 for receiving larger branches and directing them to a chipper plate 27. Such plate 27, which has several knives 51 mounted on it, "slices" the branches into small chips. Such chips are then expelled from the fan discharge port 23.

Figure 9:
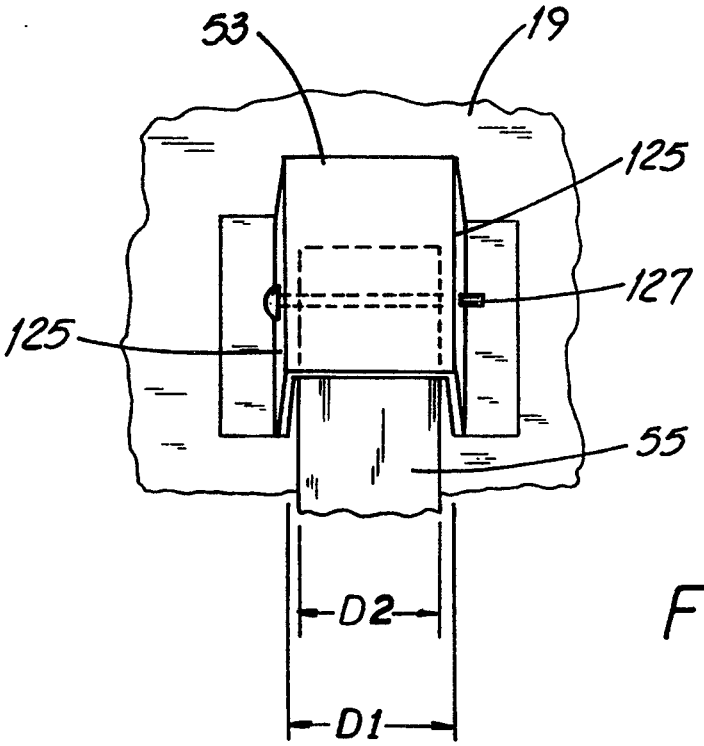
FIG. 9 is an elevation view of the strut and strut mounting bracket shown in FIGS. 1 and 2. Parts are broken away.

Referring also to FIG. 9, a strut mounting bracket 53 is secured to the outer surface of the fan chamber portion 19 of the housing 11 and supports a ground-contacting strut 55 when the machine 10 is in use. That is, the machine 10 normally rests on the two wheels 37 and on the strut 55.

Figure 2:
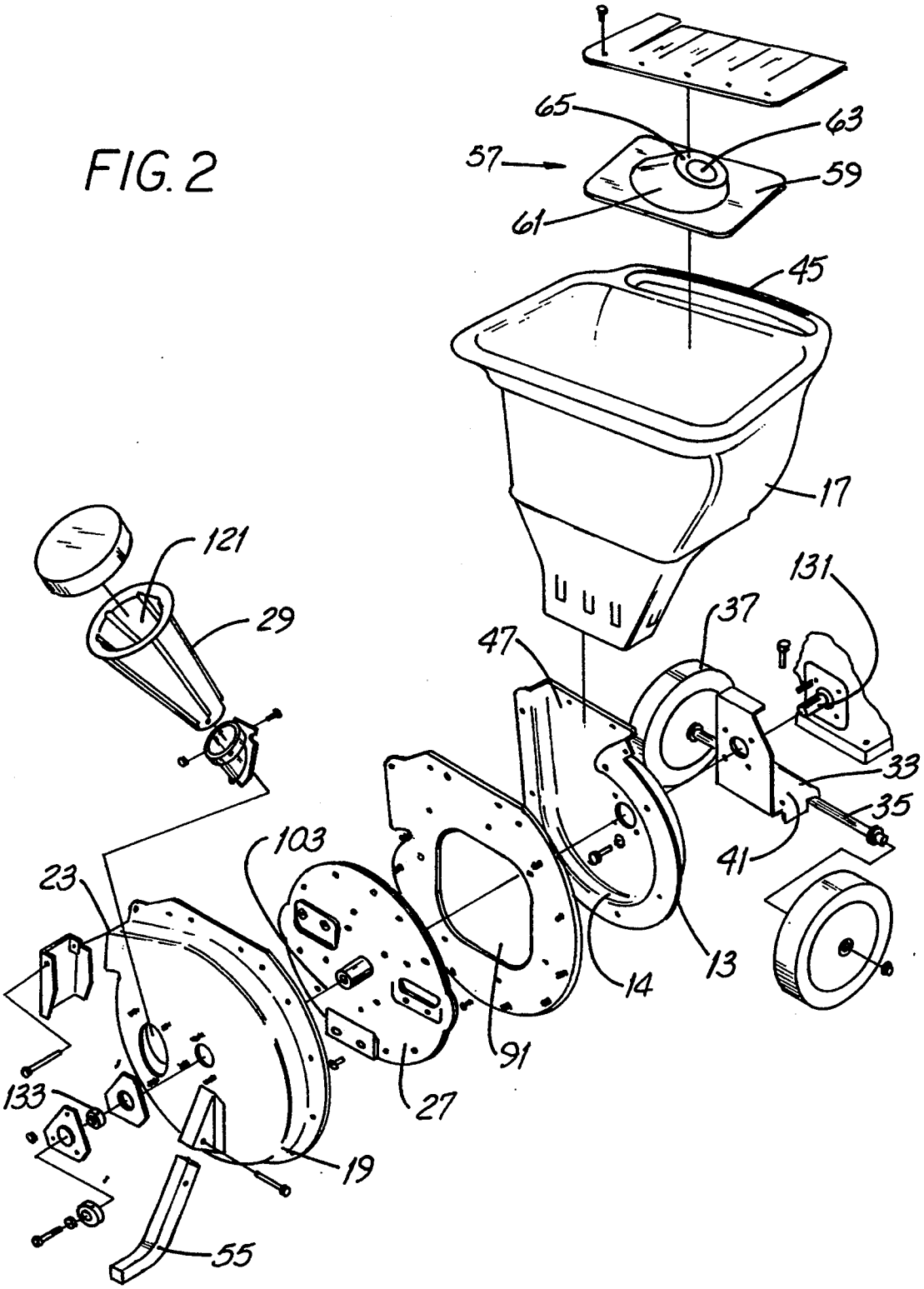
FIG. 2 is an exploded view of the machine of FIG. 1.
Figure 4:
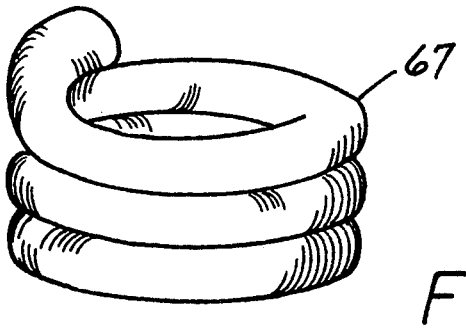
FIG. 4 is a perspective view of exemplary vacuum hose useful with the machine of FIG. 1.
Figure 6:
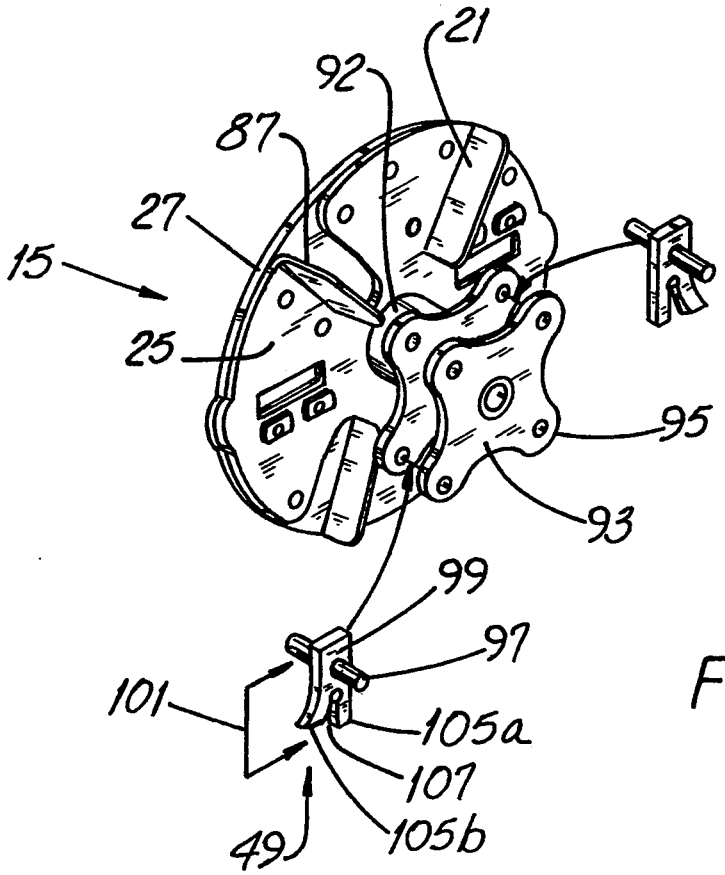
FIG. 6 is a partially-exploded view of the comminuting and fan assembly of the machine.
Figure 11:
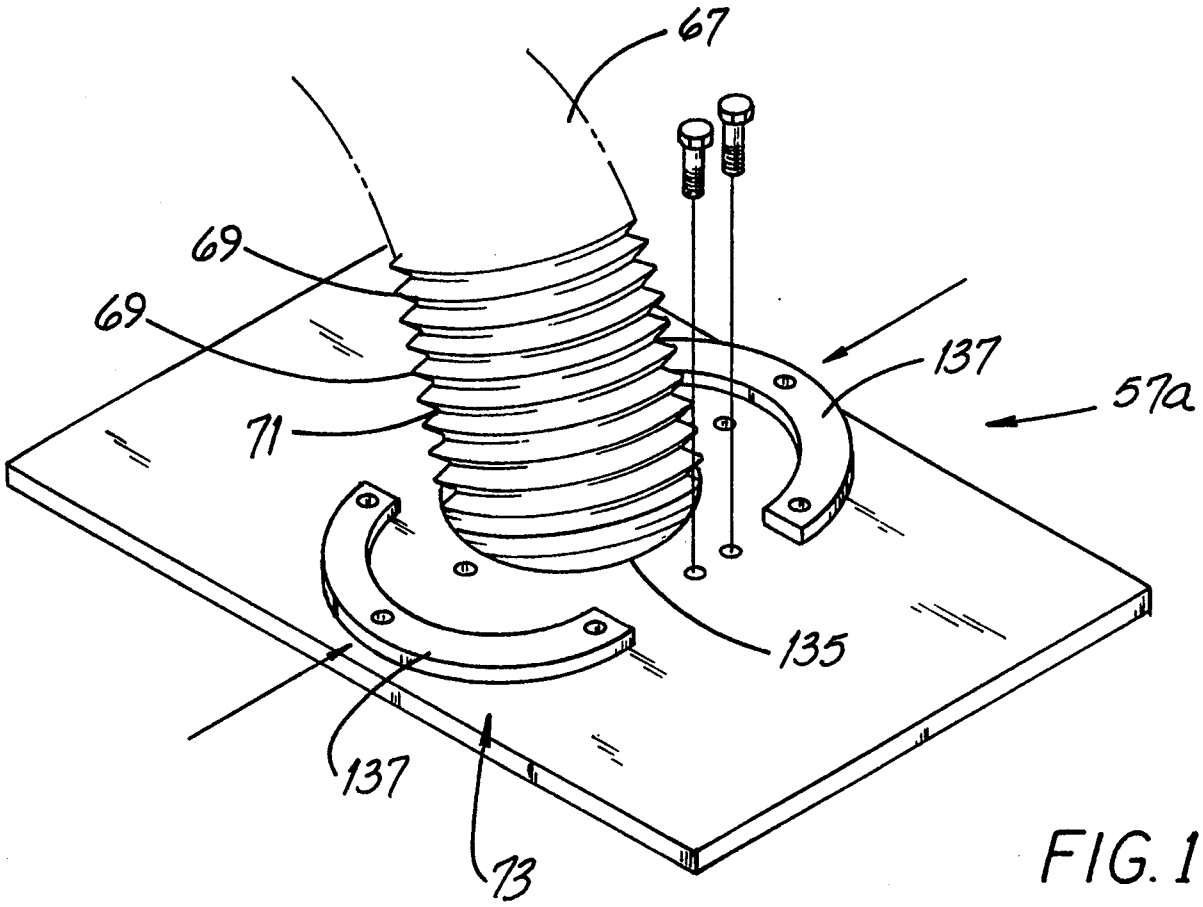
FIG. 11 is a perspective view of an alternate embodiment of a vacuum adapter plate.

A more detailed description of aspects of the new chipper-shredder machine 10 will now be set forth. Referring to FIGS. 2, 3 and 11, the machine 10 includes a unique metal or plastic vacuum adapter 57 having a rectangular flange 59 from which protrudes a rounded boss 61 having a circular opening 63. Fitted to the perimeter of the opening 63 is a resilient ring-like collar 65, the inside aperture diameter of which is selected in view of a diameter of the vacuum hose 67 depicted in FIG. 4. A suitable adapter 57, made for an entirely different purpose, is available from Oatey Company and is known as its "NO-CALK" roof-mount fitting.

Preferably, such hose 67 comprises a length of irrigation or drainage hose which includes a plurality of spaced circumferential ribs 69. The diameter of the collar aperture is preferably selected to be somewhat less than the smallest outside diameter of the hose 67. Such hose 67 is thereby readily urged into the collar 65 and well retained by the collar 65 which "seats" in a groove 71 between a pair of ribs 69 and seals around the hose 67. However, the hose 67 can turn within the collar 65. An alternate embodiment of a vacuum adapter 57*a* using a hoop-like C-clamp device 73 is described below in connection with FIG. 11.

There are at least four important benefits from the arrangement described above. One is that the hose 67 can be attached to and removed from the adapter 57 without the use of tools. Another is that since the hose 67 extends nearly vertically out the top of the hopper 17, the hose 67 is readily pivoted to "point" in any direction 360° around the machine perimeter. One does not need to "dedicate" a substantial length of hose 67 merely to get its distal end to that side of the machine 10 where it is used as a vacuum wand to pick up leaves, other lawn refuse, etc. In contrast, consider the side-mounted hose arrangement shown in the aforementioned Peck et al. patent.

A third benefit is that, as described below, the adapter 57 itself can be quickly attached and removed without the use of tools. A fourth benefit is that the hose 67 and the adapter 57 are mass-produced, relatively-low-cost products (made for disparate purposes) and this has important implications for reducing the cost of the machine 10.

Referring further to FIGS. 2 and 3 and also to FIG. 5, the hopper 17 has a shoulder 75 extending at least partially around its interior perimeter. The adapter 57 is retained on the hopper 17 in shoulder-abutting relationship so as to seal well against the shoulder 75. Adapter retention is preferably by at least one bump-like projecting member 77 (and preferably several such members 77) molded into the inner surface of the hopper 17 and positioned adjacent to but spaced slightly from the shoulder 75. Whether being mounted or removed, the adapter 57 is readily urged over the members 77 and "snapped" into or out of the hopper 17 without the use of tools.

Whether or not the vacuum adapter 57 and hose 67 are used, the mouth 79 of the hopper 17 is obstructed by a multi-fingered guard 81 attached near one edge of the hopper 17. The guard helps prevent debris from being projected out of the hopper 17 and also discourages insertion of a hand or arm into the hopper 17 and, possibly, into the grinding portion.

Considering FIGS. 2, 6, 7 and 8A, the machine 10 has a wheel-like comminuting and fan assembly 15 which rotates within the housing 11 at relatively high speed. Such assembly 15 includes a generally planar chipper plate 27 having plural openings 83. A chipping knife 51 is attached adjacent to each opening and as indicated by the arrows 85, rotation of the assembly 15 is in a direction so that branches and the like fed into the machine 10 through the tube 29 are "sliced" bologna-style into small chips, whereupon such chips are blown out the discharge port 23. The knives 51 are mounted in a unique way explained below in connection with a further discussion of FIGS. 7 and 8A, 8B and 8C.

Back-to-back with the chipper plate 27 is a generally planar fan plate 25 having outwardly-bent blades 87. The plates 25, 27 are attached to one another by bolts, rivets 89 or the like. The blades 87 produce air flow which urges material being comminuted in the grinding chamber portion 13 to "migrate" through the opening 91 in the divider plate 93 and be blown out the discharge port 23. And of course, chips cut from limbs by the knives 51 are also blown out. It is to be appreciated that the chipper plate 27 and the fan plate 25 are in the fan chamber portion 19 of the housing 11.

In one embodiment configured for use with a gasoline engine 39*a* as a prime mover 39, the plates 25, 27 are both steel. In another embodiment configured for use with an electric motor as a prime mover 39, the chipper plate 27 is fabricated of aircraft-quality aluminum plate for reduced weight.

The fan plate 25 and fan chamber portions 19 are cooperatively sized and configured to provide what is generally known as a scroll-type centrifugal blower. On its suction side, such blower creates negative pressure by drawing in air (with or without entrained refuse) through the inlet port 47 and on its discharge side, creates positive air pressure at the discharge port 23.

The assembly 15 also has an extending boss 92 to which is attached a pair of generally cloverleaf-shaped grinding rotors 93, neither of is in the fan chamber portion 19. Each rotor 93 has several radially outwardly extending lobes 95 and a stud 97 extends between the corresponding lobe 95 of each rotor 93 for mounting a free-swinging comminuting blade 49. That is, each blade 49 is free to swing 360° about the stud long axis.

Each blade 49 has a blade body 99 coincident with a plane 101 (such plane 101 being normal to the axis of rotation 103) and also has a pair of comminuting fingers 105 extending from the body. One finger 105*a* is substantially coincident with the plane 101 and the other finger 105*b* is bent away from the plane 101. And the fingers 105 are spaced apart by a slot 107. An advantage of this type of blade 49 is that, unlike the blades depicted in the Fortney and Reschke patents mentioned above, twigs and similar refuse are less likely to get caught between the blade fingers 105 and simply be carried around by a blade rather than being comminuted thereby.

It is to be appreciated that neither grinding rotor 93 nor the blades 49 are in the fan chamber portion. And, preferably, the opening 91 is a square with rounded corners; no inwardly-protruding scallop-like edges are included or necessary.

Referring to FIGS. 2, 7, 8A, 8B and 8C, the seat 109 for the chipper knife 51 is formed in a unique way that results in very little added manufacturing cost above that incurred to attach the fan plate 25 and the chipper plate 27 to one another. Attachment of the plates 25, 27 is preferably by rivets 89, one of which is shown in its undeformed configuration in FIG. 8B. The plates 25, 27 and the rivet 89 therethrough are rested on a platen 111 and impacted by a rivet setting tool, not shown.

Figure 8C:
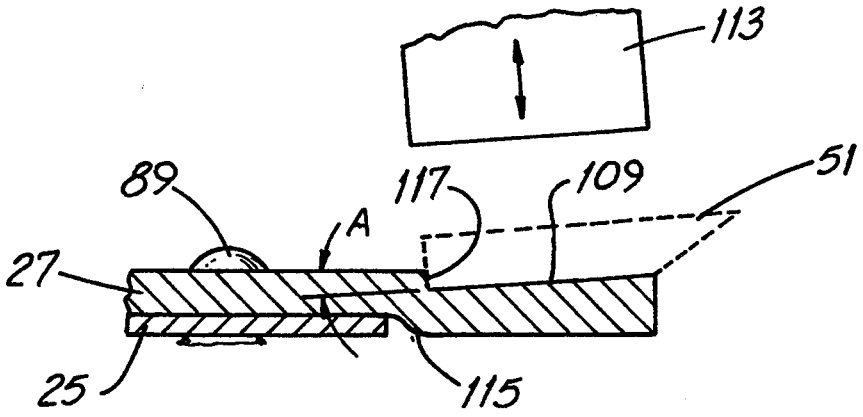
FIG. 8C is an inverted view generally like that of FIG. 8B and showing the chipper plate and the rivet subsequent to securement by rivet deformation. Also shown is a knife-receiving pocket formed simultaneously with securement.
Figure 8B:
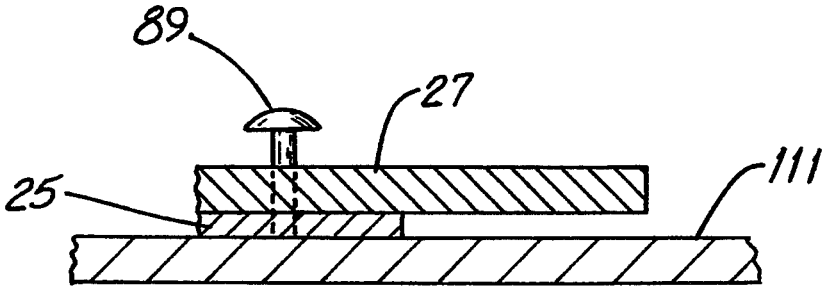
FIG. 8B is an inverted view generally like that of FIG. 8A and showing the chipper plate and an attaching rivet prior to securement.

Simultaneously, a sharp-shouldered seat forming tool 113 impacts the chipper plate 27 and upset-forms the surface thereof to define a pocket-like knife-receiving seat 109. The seat 109 is at an angle "A" of about 2°–3° with the surface of the chipper plate 27 to provide what is known as "back relief" to the knife. As the chipper plate 27 is upset formed, its opposing surface 115 bulges outward as shown in FIG. 8C.

A significant aspect of the foregoing is that no metal is removed from the chipper plate 27; rather, such metal is deformably upset. The ledge 117 resulting from such operation provides a bearing surface which "backs up" the knife 51 during chipping operations. This back-up feature (which is known per se) helps avoid straining and shearing the bolts 119 holding the knife 51 to the plate 27.

Referring again to FIG. 2, a tapered, cone-like tube 29 is coupled to the fan chamber portion 19 of the housing 11 for directing tree branches toward the chipper plate 27. The tube 29 includes a branch-receiving mouth 121 and the machine 10 has a fully removable disc-like closure 123 for sealing the mouth 121 when lawn refuse flowing through the hose 67 or is being otherwise fed in through the hopper 17. When the tube 29 is so sealed, the vacuum capability of the machine 10 is increased and the adapter-attached hose 67 does a better job of picking up lawn refuse. In a highly preferred machine 10, the closure 123 is sized and shaped to fit a commercially-available frozen food container and is available from a vendor of such containers. One exemplary closure is from a plastic, tub-like ice cream container.

Referring now to FIGS. 2 and 9, it will be recalled that the new machine 10 has a substantially-reduced tendency to dance or walk on a hard surface during use. A feature believed to be responsible for this characteristic involves a scoop-shaped strut mounting 53 bracket attached to the fan chamber portion 19 of the housing 11. The bracket 53 includes a pair of support members 125 which are spaced by a first dimension "D1." The strut 55 is attached to the bracket 53 by a pin 127 and, preferably, has a width second dimension "D2" no more than about 95% of the first dimension "D." While not wishing to subscribe to any particular theory as to why this arrangement helps reduce vibration, it is believed that housing vibration is significantly isolated from the strut 55 because of the strut-bracket spacing.

Figure 10:
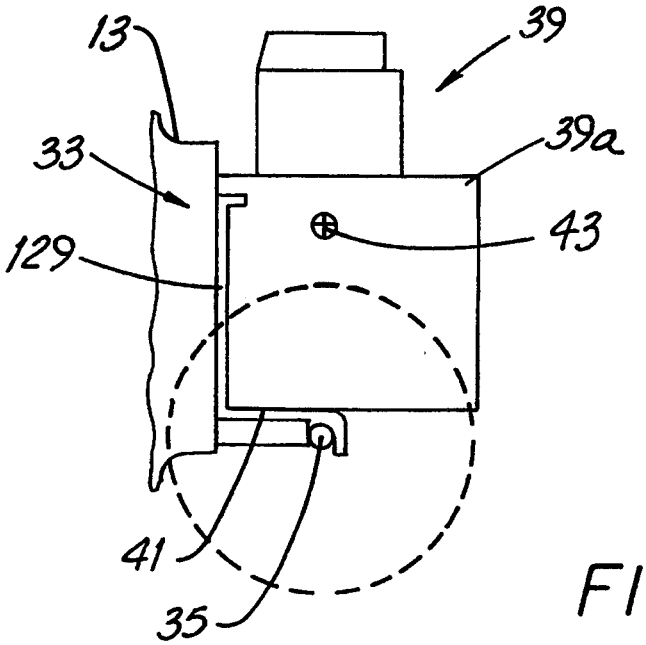
FIG. 10 is a side elevation view showing the relative location of the prime mover center of gravity and the wheel axle.

As depicted in FIGS. 2 and 10, a generally L-shaped prime mover mounting bracket 33 has its vertical panel 129 attached to the grinder portion 13 of the housing 11. The bracket platform 41 extends away from such portion 13 and has a machine-supporting axle 35 mounted to it. A prime mover 39, e.g., an internal combustion engine 39*a*, has a center of gravity 43 substantially vertically above the axle 35. And such center of gravity 43 is relatively closely spaced to the axle 35. The former feature permits the machine 10 to be readily tipped and wheeled "cart fashion" to a new location using the convenient handle 45. The latter feature improves machine stability in that the machine 10 is not "top heavy."

There is another factor which undoubtedly contributes to the fact that the machine 10 is relatively immobile in use, even on a hard surface. The prime mover drive shaft 131 (which powers the comminuting and fan assembly 15) extends through the housing 11 and is supported at its distal end by a bearing 133 in the fan portion 19 of the housing 11. This arrangement substantially avoids the shaft "whip" which often attends a cantilevered shaft (a shaft supported at only one end) rotating slightly unbalanced loads.

FIG. 11 illustrates an alternate embodiment of a vacuum adapter plate 57*a* which is sheet-like, generally planar and has an opening 135 through it sized to receive the end of a hose 67. Two C-brackets 137 are attached to the plate 57a and when so attached, they seal against the hose 67 between a pair of ribs 69.

The embodiment of FIG. 11 offers the benefits of good vacuum seal against the hose 67, easy 360° pivoting rotation of the hose 67, easy attachment to and removal from the hopper 17 (in the same way as described above) and inexpensive manufacturing cost. The hose 17 is attached by minimal use of tools and once attached, need only rarely be removed.

While the principles of the invention have been described in connection with specific embodiments, it is to be understood clearly that such embodiments are exemplary and are not limiting.

We claim:

1. In a machine for comminuting lawn refuse and having a refuse-receiving hopper with a hopper opening, the improvement comprising:

a vacuum adapter attached to the hopper and substantially spanning the opening;

a collar on the adapter for removably receiving a vacuum hose in air flow communication with the hopper;

and wherein:

the hose is generally circular in cross-section;

the collar includes a resilient member having a generally circular aperture therethrough; and the diameter of the aperture is less than that of the hose, whereby the hose is pivotably retained.

2. The machine of claim 1 wherein the hopper has a shoulder extending at least partially around the hopper perimeter and the adapter is retained on the hopper in shoulder-abutting relationship.

3. The machine of claim 2 including at least one member adjacent to the shoulder for securing the adapter to the hopper.

4. The machine of claim 1 wherein the hose includes a plurality of spaced circumferential ribs.

5. In a machine for comminuting lawn refuse and having a refuse-receiving hopper with a hopper opening, the improvement comprising:

a vacuum adapter attached to the hopper and substantially spanning the opening;

a collar on the adapter for removably receiving a vacuum hose in air flow communication with the hopper;

a grinding rotor with at least one comminuting blade pivot-mounted thereon for 360° rotation with respect to the rotor;

the blade has a blade body coincident with a plane and also has a pair of comminuting fingers extending from the body; and, one finger is substantially coincident with the plane and the other finger is bent away from the plane.

6. The machine of claim 5 wherein the fingers are spaced apart by a slot.

7. In a machine for comminuting lawn refuse and having a refuse-receiving hopper with a hopper opening, the improvement comprising:

a vacuum adapter attached to the hopper and substantially spanning the opening;

a collar on the adapter for removably receiving a vacuum hose in air flow communication with the hopper;

a grinding rotor, a fan and a housing enclosing the rotor and fan, and wherein;

a tube is coupled to the housing for directing tree branches toward the rotor;

the tube includes a branch-receiving mouth; and, the machine includes a closure for sealing the mouth when lawn refuse is flowing through the hose.

8. The machine of claim 7 wherein the closure is sized and shaped to fit a commercially-available frozen food container.

9. In a machine for comminuting lawn refuse and including (a) a grinding chamber having an inlet port, and (b) a refuse-receiving hopper with an upper rim, the improvement comprising:

a vacuum adapter attached to the hopper and positioned within the hopper intermediate the upper rim and the inlet port;

a collar on the adapter for removably receiving a vacuum hose in air flow communication with the hopper;

a grinding rotor, a fan and a housing enclosing the rotor and fan, and wherein:

a strut mounting bracket is attached to the housing and includes a pair of spaced support members;

a strut is retained between the support members in spaced relation thereto.

10. The machine of claim 9 wherein the support members are spaced by a first dimension and the strut has a width no more than about 95% of the first dimension whereby the strut is out of contact with the support members.

11. The machine of claim 9 including:

a machine-supporting axle;

a prime mover having a center of gravity;

and wherein:

the prime mover is mounted with its center of gravity substantially vertically above the axle, whereby the machine is stable in use and readily tipped for machine relocation.

12. In a machine for comminuting lawn refuse and including (a) a grinding chamber having an inlet port, and (b) a refuse-receiving hopper with an upper rim, the improvement comprising:

a vacuum adapter attached to the hopper and positioned within the hopper intermediate the upper rim and the inlet port;

a collar on the adapter for removably receiving a vacuum hose in air flow communication with the hopper;

a comminuting and fan assembly having a chipper plate with at least one chipping aperture therethrough;

a chipping knife mounted on the plate adjacent to the aperture;

and wherein:

the chipper plate is generally planar and has generally parallel first and second surfaces;

the chipping knife is received in a pocket upset-formed in the first surface; and the second surface bulges outward away from the first surface.

13. In a machine for comminuting lawn refuse and including (a) a grinding chamber having an inlet port, and (b) a refuse-receiving hopper with an upper rim, the improvement comprising:

a vacuum adapter attached to the hopper and positioned within the hopper intermediate the upper rim and the inlet port;

a collar on the adapter for removably receiving a vacuum hose in air flow communication with the hopper;

a comminuting and fan assembly having a chipper plate with at least one chipping aperture therethrough;

a chipping knife mounted on the plate adjacent to the aperture;

and wherein:

the chipping knife is received in an upset-formed pocket;

the assembly also includes a fan plate;

the chipper plate and the fan plate are secured together by rivets; and, the pocket is upset-formed simultaneously with rivet setting.

* * * * *